United States Patent [19]

Iglesias

[11] 4,428,510

[45] Jan. 31, 1984

[54] ACTIVATING DEVICE FOR A PRESSURIZED CAN

[76] Inventor: Ney M. Iglesias, 1070 Fanny St., Elizabeth, N.J. 07201

[21] Appl. No.: 305,529

[22] Filed: Sep. 25, 1981

[51] Int. Cl.[3] ..... B65D 83/14

[52] U.S. Cl. ..... 222/180; 239/274

[58] Field of Search ..... 222/180, 505, 509, 649, 222/173, 402.1, 402.14, 402.15; 239/274; 267/8 R, 113, 114, 126, 136, 137; 16/66, 84, DIG. 21

[56] References Cited

U.S. PATENT DOCUMENTS

| | | | |
|---|---|---|---|
| 1,304,585 | 5/1919 | McFarland | 267/114 |
| 1,966,956 | 7/1934 | Dunn | 16/84 |
| 3,662,958 | 5/1972 | German | 239/274 |
| 3,680,739 | 8/1972 | Karr | 222/639 |
| 3,858,762 | 1/1975 | Meshberg | 222/180 |

*Primary Examiner*—Joseph J. Rolla
*Assistant Examiner*—Thomas Fitzgerald
*Attorney, Agent, or Firm*—James M. Trygg

[57] ABSTRACT

An activating device for a pressurized can for dispensing a controlled amount of the contents thereof in response to the opening or closing of a door. The device can easily accomodate installations wherein the door and door frame are not flush.

3 Claims, 10 Drawing Figures

FIG. 1
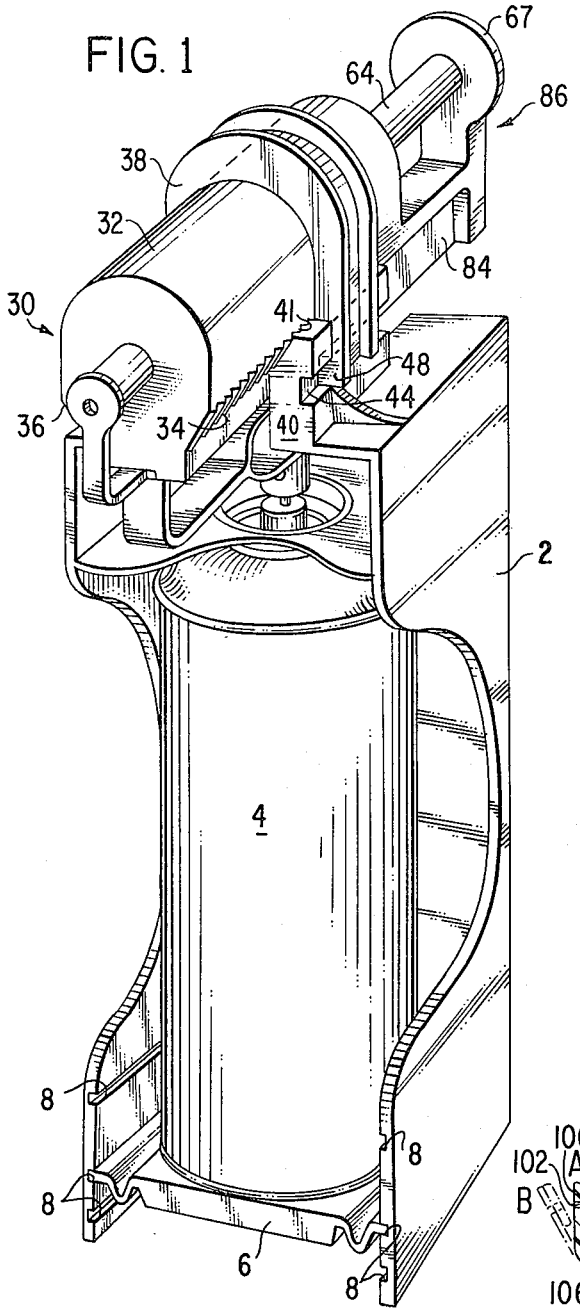
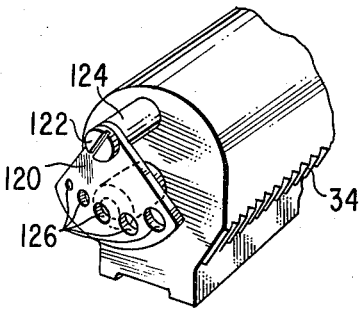
FIG. 2
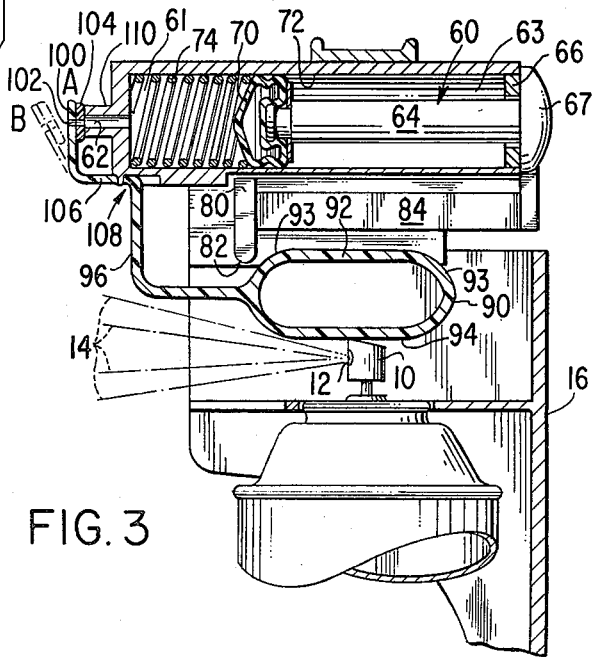
FIG. 3

ACTIVATING DEVICE FOR A PRESSURIZED CAN

DESCRIPTION

BACKGROUND OF THE INVENTION

This invention relates to activating devices for pressurized aerosol containers and more particularly to such devices for dispensing the contents of pressurized aerosol containers in response to the opening or closing of a door.

Such devices are well known and typically utilize a housing, or frame, for holding the aerosol can in operating position. The housing is attached to the door, usually close to the top, adjacent to the door frame. A plunger or activating lever is generally associated with the housing and arranged for pivotal or sliding motion with respect thereto. The plunger or lever is spring biased against the door frame. When the door is opened the plunger or lever is then set in motion, under the pressure of the spring, and moves in such a way that the push valve of the aerosol can is momentarily depressed, thus dispensing a portion of the contents of the aerosol can. Examples of such devices utilizing plungers to activate the push valve of the aerosol can are disclosed in U.S. Pat. No. 3,858,762, issued Jan. 7, 1975 to Meshberg and U.S. Pat. No. 3,662,958, issued May 16, 1972 to German. Devices utilizing levers to activate the push valve of the aerosol can are generally similar to the device disclosed in U.S. Pat. No. 3,994,440, issued Nov. 30, 1976 to Mancini. All such devices, however, dispense the contents of the aerosol container at an uncontrolled rate. Further, the time for which the push valve of the aerosol container is held open is not easily adjustable by either the manufacturer or the user of the device. Such an adjustment is often desirable so that a single model of dispensing device may be utilized in a variety of applications having diverse requirements. Another disadvantage of prior art devices of this type is the difficulty encountered when attempting to install them on doors which are not substantially flush with their door frames. The present invention overcomes these difficulties of the prior art through use of a novel pneumatic actuator and mounting mechanism.

It is therefore an object of this invention to provide an activating device for a pressurized can wherein the time interval within which the push valve of the can is activated is readily adjustable.

It is another object of this invention to provide an activating device for a pressurized can that can be easily and quickly installed on a door that is not flush with its door frame.

Other objects and advantages of the invention will become apparent through reference to the accompanying drawings and descriptive matter which illustrate a preferred embodiment of this invention.

SUMMARY OF THE INVENTION

According to the present invention there is provided a dispensing device for a pressurized container having a valve for expelling the contents thereof. The dispensing device has a housing means for holding the container in operating position and a pneumatic means for actuating the valve for a predetermined period of time. The pneumatic means comprises: a body portion having an interior cavity containing air; plunger means arranged for movement relative to the interior cavity for dispensing a predetermined quantity of the air; and orifice means for metering the displacing of the predetermined quantity of air thereby controlling the rate of movement of the plunger means.

BRIEF DESCRIPTION OF THE DRAWINGS

In order that the invention be more fully understood, it will now be described by means of example with reference to the accompanying drawings in which:

FIG. 1 is an isometric view of an activating device for a pressurized can showing the present invention incorporated therin;

FIG. 2 is an isometric partial view of the activating device shown in FIG. 1;

FIG. 3 is a partial sectional view of the activating device shown in FIG. 1;

DESCRIPTION OF THE PREFERRED EMBODIMENT

Figure 8:
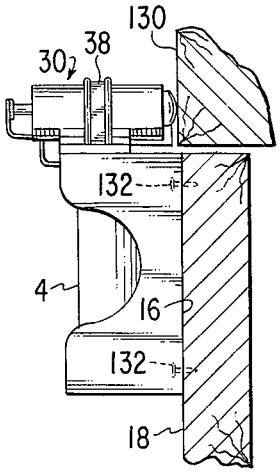
FIG. 8 is a side view of the activating device of FIG. 1 shown installed on a door flush with its frame.
Figure 9:
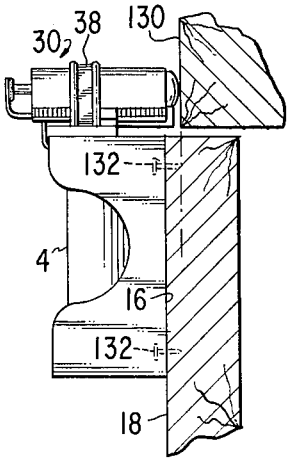
FIG. 9 is a view similar to that of FIG. 8 wherein the door protrudes from the frame.
Figure 10:
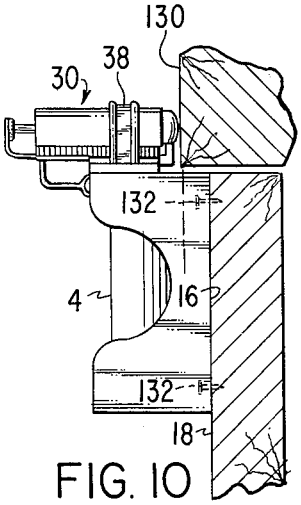
FIG. 10 is a view similar to that of FIG. 8 wherein the door is recessed into the frame.

Referring to FIGS. 1, 2, and 3 there is shown an activating device for a pressurized can having a housing 2 for holding a can 4 in proper operating position, in this case in a vertical position. An adjustable shelf 6 slidingly engages any of several slots 8 for accomodating cans of various heights. The can 6 is equiped with a push valve 10 having an exit nozzle 12 arranged for dispensing the contents of the can in the form of a spray 14 in a notoriously well known manner. The can 6 is arranged within the housing 2 so that the spray 14 is dispensed to the left as viewed in FIG. 3. A surface 16 of the housing 2 is provided for mounting the unit to the surface of a door 18 as shown in FIGS. 8, 9, and 10.

A pneumatic activator 30 having a body 32 and two rows of serrations 34 and 36 is adjustably secured to the housing 2 by a U shaped bracket 38. The serrations 34 and 35 are inclined somewhat with respect to the vertical. Anchor lugs 40 and 42 formed in the housing 2 are arranged on either side of the body 32 and have two rows of serrations 41 and 43 inclined to correspond to and lockingly engage with the serrations 34 and 36. The serrations 34 and 36 extend along substantially the entire length of the body 32 thereby permitting adjustment in the positioning of the pneumatic actuator 30 with respect to the housing 2. While the anchor lug 42 is hidden from view, as seen in FIG. 1, it is a mirror image of the anchor lug 40 and is similarly located but in relation to the serrations 36. Each anchor lug 40 and 42 has an open ended slot 44 and 46 respectively, formed therein facing outwardly and away from the pneumatic actuator 30. A pair of turned in ends 48 are formed on the ends of the U shaped bracket 38 for slidingly engaging the two open ended slots 44 and 46. The two open ended slots 44 and 46 are arranged so that when the pneumatic actuator 30 is positioned, as desired, with respect to the housing 2 and the serrations 34 and 36 are in locking engagement with the serrations 41 and 43, the U shaped bracket 38 will snuggly slide over the body 32 and the ends 48 slidingly engage the two slots 44 and 46. In this position the U shaped bracket 38 firmly secures the pneumatic actuator 30 to the anchor lugs 40 and 42 yet permits repositioning of the actuator 30 by simply sliding the bracket 38 until the pair of turned in ends 48 are out of engagement with the slots 44 and 46.

In the preferred embodiment the body 32 has an internal cavity 60 of cylindrical shape, having a distal end 61 and a proximal end 63. A passageway 62 located near the distal end provides a fluid connection between the cavity 60 and the ambient atmosphere. A plunger shaft 64, arranged to move axially within the cavity 60 is slidingly supported on the one end by a ring shaped spacer 66. A bumper button 67 rigidly attached to the end of the plunger shaft 64, prevents the shaft 64 from completely entering the cavity 60. The spacer 66 is removably attached to the proximal end 63 of the cavity 60 and has a central perforation which slidingly supports the plunger shaft 64 with sufficient clearance to permit the free venting of air within the cavity 60. A plunger seal 70, made of a suitably resilient material is fastened to the other end of the plunger shaft 64 and is arranged to form a fluid seal along the interior wall 72 of the cavity 60. A coil spring 74 is arranged within the cavity 60 to urge the plunger seal 70 and shaft 64 to move away from the distal end 61 of the cavity. Such movement will cause ambient air to be drawn into the cavity 60 through the passageway 62.

A cam 80 having a cam surface 82 is supported on a bar 84 having a T shaped cross section which in turn is rigidly attached to the bumper button 62 at 86. With this construction the cam 80 will move with, and in the same direction as the plunger shaft 64.

An actuator member 90 having an upper surface 92 and a lower surface 94 which is substantially parallel to the upper surface is supported by a resilient member 96 formed integral thereto. The resilient member 96 is sufficiently stiff to maintain the actuating member 90 in a neutral position, as shown in FIG. 3, yet sufficiently flexible to permit limited movement toward and away from the push valve 10. The upper surface 92 is characterized by a flat portion blending on either end with rounded portions 93.

An orifice member 100 having an orifice 102 and a ring shaped pad 104 is supported by a resilient member 106 which is attached to the body 32 at 108. The resilient member 106 is arranged to bias the orifice member 100 in a direction toward the body 32 causing the pad 104 to sealingly engage a projection 110 having the passageway 62 formed therethrough. In this position the orifice 102 is in fluid registry with the passageway 62 and is indicated at A in FIG. 3. The resilient member 106 is sufficiently flexible to permit limited movement of the orifice member 100 away from the projection 110 to permit rapid venting of the distal end 61 of the cavity 60. This position of the orifice member 100 is indicated at B in FIG. 3.

An alternative construction of the orifice member 100 is shown in FIG. 2. A pie shaped resilient member 120 is pivotally attached to the body 32 by a suitable screw fastener 122 and spacer 124. A series of different diameter holes 126 are formed in the member 120 each of which may be brought into fluid registry with the passageway 62 by simply pivoting the member 120. The screw fastener 122 provides sufficient resistance to pivoting so that once set, the member 120 will not pivot further due to normal vibrations encountered during use. With this arrangement any one of a variety of orifice sizes may be selected. The member 120 is sufficiently flexible to permit venting the cavity 60 in a manner similar to that of the orifice member 100.

Referring to FIGS. 8, 9, and 10 the activating device is shown installed on a door surface 18 with the bumper button 67 in abutting contact with the door jamb 130. In this position the plunger shaft 64 and plunger seal 70 are moved toward the distal end 61 as far as possible and against the biasing force of the spring 74. The activating device will accomodate a variety of different door and door jamp arrangements as shown in FIGS. 8, 9, and 10. FIG. 8 shows an installation wherein the door surface 18 is flush with the door jamb, while FIGS. 9 and 10 show installations wherein the door surface 18 is protruding from or recessed into the door jamb respectively. In such installations the housing 2 is secured to the door surface 18 by suitable fasteners 132. With the door closed the pneumatic activator 30 is positioned as shown in FIGS. 8, 9, or 10 and the U shaped bracket 38 installed as described above. As will be appreciated by those skilled in the art, the installation of this device in a variety of door/door jamb arrangements is extremely simple.

Figure 4:
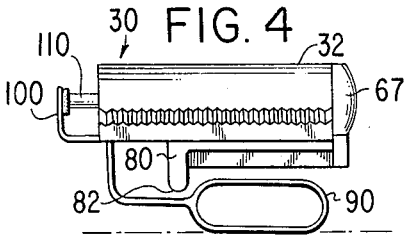
FIG. 4 is a partial side view of the activating device shown in FIG. 1 with the door closed.
Figure 5:
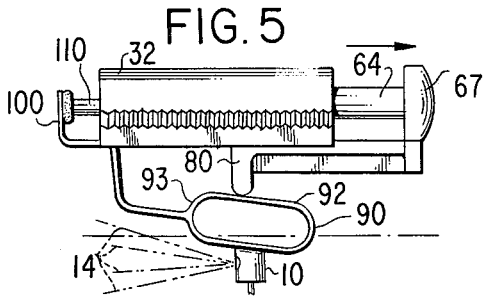
FIG. 5 is a view similar to that of FIG. 4 with the door opening.
Figure 6:
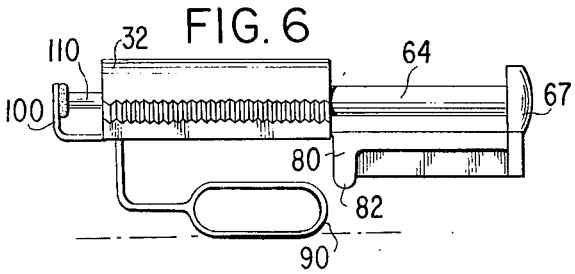
FIG. 6 is a view similar ro that of FIG. 4 with the door fully opened.
Figure 7:
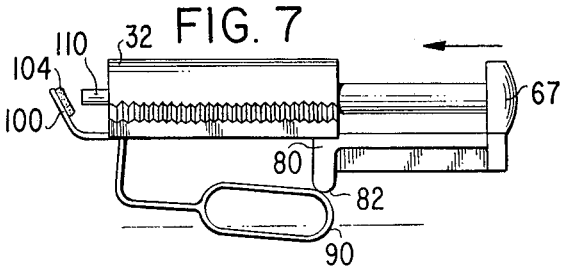
FIG. 7 is a view similar to that of FIG. 4 with the door closing.

In operation, the device utilizes the restricted flow of ambient air through the orifice 102 into the distal end 61 of the cavity 60 to control the rate of movement of the plunger shaft 64 under the biasing force of the spring 74. FIGS. 4 through 7 illustrate this operation. FIG. 4 shows the pneumatic actuator 30 with the plunger shaft 64 fully retracted into the cavity 60 of the body 32. In this position the cam 80 is not in engagement with the actuator member 90. This position is equivalent to that shown in FIGS. 3, and 8 through 10. Referring to FIG. 5, after the door is opened, the bumper button 67 is no longer in abutting contact with the door jamb. The plunger seal 70 and the shaft 64 are urged toward the proximal end 63 by the biasing force of the spring 74. As the plunger seal 70 moves, air from the proximal end 63 of the cavity 60 is freely vented into the atmosphere, as described above, and concurrently, ambient air is drawn into the distal end of the cavity 60 at a rate predetermined by the size of the orifice 102 in relation to the biasing force provided by the spring 74. As the plunger shaft 64 moves at a fixed rate due to the metering effect of the orifice 102 the cam 80 moves into contact with the actuator member 90. The cam surface 82 engages the curved surface 93 and them the flat surface 92 causing the actuator member 90 to move vertically downwardly into actuating contact with the push valve 10 thereby dispensing a portion of the contents of the pressurized can 4 as shown in FIG. 5. When the plunger shaft 64 reaches the end of its travel, as shown in FIG. 6, the cam 80 is no longer in actuating contact with the member 90 which then moves back to its neutral position under the urging of the resilient member 96 whereby the push valve 10 returns to its nondispensing position under the biasing force supplied by a spring internal to the pressurized can 4. As the door closes, see FIG. 7, the bumper button 67 comes into abutting contact with the door jamb causing the plunger shaft 64 to rapidly inter the cavity 60, freely drawing ambient air into the proximal end of the cavity 60 and rapidly expelling air from the distal end of the cavity 60. The passageway 62 is sufficiently large to permit this rapid expulsion of air. As the expelled air exits the passageway 62 the orifice member 100 moves out of sealing engagement with the projection 110 as shown in FIG. 7 and at B in FIG. 3. As the plunger shaft 64 rapidly moves back to the position shown in FIG. 4, the cam 80 again rides along the surface 92 thereby depressing the actuating member 90 and causing the push valve 10 to secondarily dispense a relatively small amount of the contents of the can 4. To eliminate this secondary dispensing, the cam 80 can be hinged to the bar 84 so that the cam 80 will act upon the actuating member 90 when the plunger shaft 64 is moving as shown in FIG. 5 but will not act upon the actuating member 90 when the plunger is moving in the reverse direction as shown in FIG. 7. Such a one way hinged structure is notoriously well known and will therefore not be described further here.

Upon reviewing the present disclosure, a number of alternative constructions will occur to one skilled in the art. Such constructions may utilize various orifice arrangements that may meter displaced air that is permitted to flow from the distal end to the proximal end of the internal cavity. This could be accomplished by an orifice located in the plunger seal 70 or by a bypass tube providing a fluid couple between the two ends of the cavity 60. These and other such alternative constructions are considered to be within the spirit and scope of this invention.

I claim:

1. A dispensing device for a pressurized container having a valve for expelling the contents thereof, said dispensing device having a housing means for holding said container in operating position, and pneumatic means for activating said valve for a predetermined period of time, wherein said pneumatic means comprises:

a. a body portion having an interior cavity containing air;

b. a plunger means arranged for movement relative to said interior cavity for displacing a predetermined quantity of said air; and c. orifice means for metering said displacing of said predetermined quantity of air thereby controlling the rate of said movement of said plunger means, wherein said pneumatic means includes an actuating member arranged for movement in a first direction into operational engagement with said valve for actuation thereof, and in a second direction out of said operational engagement with said valve, and wherein said plunger means includes a cam surface carried therewith and arranged to effect said movement of said actuating member in said first direction when said plunger porton partakes of said sliding motion in said predetermined direction.

2. The combination of claim 1 wherein said actuating member includes a resilient portion, one end of which is attached to said actuating member and the other end of which is attached to said body portion, said resilient portion being arranged to urge said actuating member out of said operational engagement with said valve and to constrain said movement of said actuating member to said first and said second directions.

3. The combination of claim 1 or 2 including clamping means for adjustably securing said pneumatic means to said housing means.

* * * * *